United States Patent [19]

Stanescu et al.

[11] 4,415,379

[45] Nov. 15, 1983

[54] HEAT TREATMENT PROCESSES

[75] Inventors: Mircea-Stefan Stanescu, Bridgewater; William T. Fitzgerald, Whitehouse Station, both of N.J.

[73] Assignee: The BOC Group, Inc., Montvale, N.J.

[21] Appl. No.: 302,336

[22] Filed: Sep. 15, 1981

[51] Int. Cl.[3] ..... C21D 1/48

[52] U.S. Cl. ..... 148/16; 148/16.5

[58] Field of Search ..... 148/16, 16.5, 16.6

[56] References Cited

U.S. PATENT DOCUMENTS

| | | | |
|---|---|---|---|
| 2,955,062 | 10/1960 | Cullen et al. | 148/16.5 |
| 3,663,315 | 5/1972 | Hoffman et al. | 148/16.5 |
| 4,049,473 | 9/1977 | Davis | 148/16.5 |
| 4,175,986 | 11/1979 | Ewalt et al. | 148/16.5 |
| 4,208,224 | 6/1980 | Girrell | 148/16.5 |
| 4,211,584 | 7/1980 | L'Hermite et al. | 148/16.5 |
| 4,294,395 | 10/1981 | Nayar | 228/220 |
| 4,322,255 | 3/1982 | Kostelitz | 148/16.5 |

OTHER PUBLICATIONS

Nayar et al, "How Furnace Zoning can Optimize Atmosphere Efficiency", Heat Treating, Mar. 1981, pp. 35, 36, 38, 39 and 42.

The Making, Shaping and Treating of Steel, pp. 417–419, 1957.

The Condensed Chemical Dictionary, p. 608, 1971.

*Primary Examiner*—John P. Sheehan

*Attorney, Agent, or Firm*—David L. Rae; Larry R. Cassett

[57] ABSTRACT

Ferrous material such as tool steel is annealed in a batch or continuous furnace into which inward leakage of an ambient oxidant occurs. The hot zone is heated to a temperature of about 1250°–1650° or higher and the material passed therethrough under a nitrogen based atmosphere comprised of nitrogen, methane and a minor addition of propane with nitrogen comprising approximately 90% of the hot zone atmosphere. Propane reacts with the oxidants to form a relatively active form of methane which, together with methane introduced as such into the hot zone, reacts effectively at low temperatures (1400° F. or below) to avoid both decarburization and sooting. The hot zone atmosphere evinces considerably lesser tendencies to decarburize or soot than atmospheres formed only of $N_2$—$C_3H_8$ mixtures and is considerably more reactive than atmospheres formed only of $N_2$—$CH_4$ mixtures at these lower temperatures.

4 Claims, 2 Drawing Figures

HEAT TREATMENT PROCESSES

BACKGROUND OF THE INVENTION

The present invention relates to methods for heat treating ferrous material and, more particularly, to methods for annealing tool steels under nitrogen based atmospheres.

In annealing ferrous material, such as for purposes of stress relief, etc., it is important to avoid changes in the surface metallurgy of the material. Thus, surface carburization and decarburization are to be avoided during annealing. It has been found that most of the tool steels have a strong tendency to decarburize during annealing even at relatively low temperatures. In addition, it has been common practice to utilize protective atmospheres such as endothermic, exothermic, or others, in the hot zones of annealing furnaces. However, as these atmospheres are derived from hydrocarbon sources such as natural gas (i.e. methane), the cost of producing these atmospheres has increased significantly in recent years. Furthermore, expensive generator devices are necessary to produce these atmospheres and these devices require considerable maintenance but yet are relatively inflexible in that they are not effective to produce a wide range of atmospheres over a wide range of flow rates. Typically, the foregoing conventional generated atmospheres are enriched with natural gas so that an adequate level of hydrocarbon is available to react with oxidants leaking to the furnace and thereby avoid decarburization or oxidation of the ferrous material being annealed.

In order to avoid carburization or decarburization of ferrous material at a particular temperature in a furnace hot zone, it is necessary to maintain an equilibrium condition between $CO_2$ and CO, i.e. maintain a predetermined ratio at a given temperature. Similarly, a given ratio between $H_2O$ and $H_2$ must be maintained to avoid oxidation of ferrous material at a particular temperature. A discussion of these ratios appears in Wire Technology, November/December, 1979, pages 51–57 which indicates that by adding a hydrocarbon to a nitrogen based atmosphere, the level of CO increases by virtue of the reaction:

$$CH_4+CO_2 \rightleftharpoons 2CO+2H_2$$

and such an increase in CO tends to reduce the ratio of $CO_2/CO$ at constant temperature to thereby reduce the decarburizing tendency of the atmosphere. Thus, methane addition is effective to control or limit the tendency of a furnace atmosphere to decarburize, but when annealing at lower temperatures, i.e. below about 1450° F., methane is relatively sluggish and simply fails to react sufficiently to avoid decarburization. Continued additions of methane fail to cure this problem.

The technique of introducing nitrogen based atmospheres comprised of nitrogen and propane into a furnace hot zone is described in Iron and Steel Engineer, November, 1980, pages 51–57. This article notes at page 52 that propane is relatively difficult to add precisely and insufficient propane results in decarburization while excessive propane leads to sooting, both highly undesirable results. This article suggests that preferred annealing atmospheres can be developed from mixtures of nitrogen and methanol ($CH_3OH$) being introduced into a furnace hot zone. Methanol will dissociate into CO and $H_2$ and will alter the ratios of $CO_2/CO$ and $H_2O/H_2$ such that tendencies toward decarburization will be reduced. Those skilled in the art will appreciate that use of methanol is costly in that separate storage vessels, pumping equipment and piping, etc. are required in order to store and transfer methanol to a heat treating furnace. Consequently, use of methanol is an expensive and rather complicated approach toward generating protective atmospheres in heat treating furnaces.

Consequently, a clear need exists for processes for annealing ferrous material such as tool steel in acceptable "soak" time periods under a nitrogen based atmosphere such that decarburization and sooting are avoided but which is not inordinately expensive and does not necessarily require methanol addition to the furnace atmosphere.

OBJECTS OF THE INVENTION

It is an object of the present invention to provide improved processes for heat treating ferrous material.

It is an additional object of the invention to provide improved processes for annealing tool steel.

It is yet another object of the invention to provide improved processes for annealing ferrous material under nitrogen based atmospheres.

It is still another object of the invention to provide improved processes for annealing ferrous material in acceptable time periods without significant carburization or decarburization.

It is a further object of the invention to provide improved processes for annealing ferrous material at relatively low temperatures under nitrogen based atmospheres.

Other objects of the invention will be apparent from a detailed description thereof which follows.

SUMMARY

In accordance with the invention, a process for annealing ferrous material in a furnace into which leakage of ambient oxidants occurs comprises the steps of: heating said hot zone to a temperature of approximately 1250°–1650° F. or higher, introducing nitrogen, methane and propane into said hot zone wherein said propane reacts with a portion of said oxidants to form relatively active methane which together with said introduced methane effectively precludes decarburization of said material by reacting with said oxidants.

In accordance with the invention, ferrous material such as tube, bar, rod, strip, etc. may be annealed in a batch or continuous furnace with nitrogen supplied to the vestibule(s) thereof to substantially exclude oxygen therefrom. In the case of a continuous furnace, there will be provided a plurality of hot and cooling sections, vestibules and different atmospheres, as necessary, will be introduced into such different sections.

By utilization of propane additions to methane-nitrogen mixtures, ferrous material may be annealed to acceptable standards at lower temperatures between approximately 1250°–1400° F. in conventional time periods. In addition, process conditions previously difficult to control when nitrogen-propane mixtures were utilized are readily controllable when propane is added to nitrogen-methane mixtures. The "gap" between carburizing and decarburizing conditions is effectively widened when utilizing $N_2$—$CH_4$—$C_3H_8$ additions which in turn renders the annealing process more stable and avoids the necessity of expensive and highly sophisticated atmosphere control equipment. Furthermore, the use of methanol, and the costs attendant thereto, may be avoided in practicing the process according to the invention.

BRIEF DESCRIPTION OF THE DRAWING

Reference will be made to the attached drawing in which.

DESCRIPTION OF PREFERRED EMBODIMENT

Figure 1:
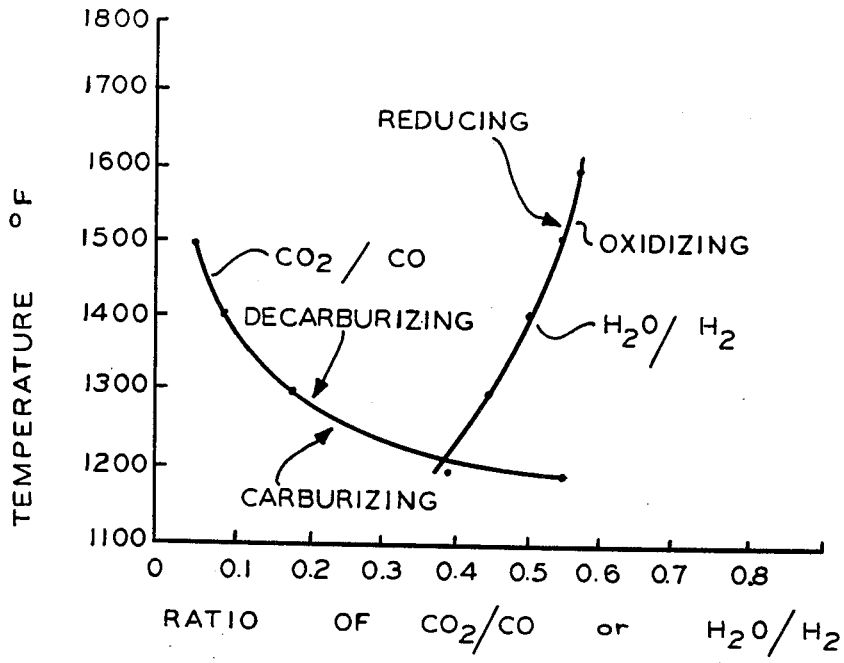
FIG. 1 is a graphical illustration of ratios of $CO_2/CO$ and $H_2O/H_2$ existing in annealing processes.

Referring now to FIG. 1, there is illustrated a set of curves which depicts the relationships between constituents of heat treating atmospheres and the tendency of such constituents to alter the carbon and oxygen content of ferrous material under nitrogen based atmospheres. In order to avoid carburization or decarburization at a given temperature, it is necessary to maintain a predetermined ratio of $CO_2/CO$. Similarly, if oxidation or reduction is to be avoided at a given temperature, the ratio of $H_2O/H_2$ must be a predetermined value. Thus, the equilibrium curves depicted in FIG. 1 define the foregoing ratios of constituents which must be maintained in order to retain carbon/oxygen levels in material in equilibrium with similar levels in the annealing atmosphere at given temperatures. When annealing under nitrogen based atmospheres, i.e. at least 70% nitrogen, there is a tendency to reduce reaction rates between hydrocarbon additions and oxidants leaking inward as nitrogen acts as a diluent. In addition, the carburizing/decarburizing equilibrium curve tends to move in the direction toward decreasing the ratio of $CO_2/CO$ at constant temperature. Because the $CO_2$ content of nitrogen based atmospheres is usually less than in conventional generated atmospheres such as endothermic gas, less CO will provide a lower $CO_2/CO$ ratio which still avoids decarburization. Consequently, although nitrogen based atmospheres are essentially inert, the same are not totally inert due, for example, to the aforementioned impact on carburizing/decarburizing equilibrium curves.

In typical annealing furnace there is a continuous, inward leakage of atmospheric oxidants. Thus, air leaking into a furnace will carry with it minor amounts of $CO_2$ and $H_2O$ which will, at typical annealing temperatures, decarburize and oxidize surfaces of ferrous materials. These results are highly undesirable during annealing as carbon content changes in steel are to be substantially avoided. In order to avoid decarburization and oxidation in accordance with the invention, propane and methane are both added to a nitrogen based atmosphere in the furnace hot zone such that the following reactions occur:

$$C_3H_8+CO_2 \rightleftharpoons 2CO+2CH_4 \quad (1)$$

$$CH_4+CO_2 \rightleftharpoons 2CO+2H_2 \quad (2)$$

$$H_2+CO_2 \rightleftharpoons CO+H_2O \quad (3)$$

$$CH_4+H_2O \rightleftharpoons CO+3H_2 \quad (4)$$

The addition of $CH_4$ will promote reactions (2) and (4) however under $N_2$ based atmospheres at lower annealing temperatures of approximately 1100°–1450° F., $CH_4$ is relatively sluggish and these reactions proceed quite slowly. Consequently, excessive time is required to reach equilibrium conditions. Such $CH_4$ additions will, in theory, provide a sufficient carbon potential to avoid decarburization but as a consequence of the failure of reactions (2) and (4) to proceed rapidly at these lower temperatures, it is difficult to control the flow rate of $CH_4$ additions because although detecting instruments will indicate that an adequate carbon potential exists in the furnace atmosphere, the actual carbon present is not fully effective to avoid decarburization due to the fact that $CH_4$ reacts slowly at such lower temperatures. In accordance with the present invention the addition of $C_3H_8$ to the hot zone of an annealing furnace supplied with nitrogen and methane is effective to rapidly promote all of reactions (1)–(4). As propane reacts with $CO_2$ rapidly at temperatures above 1100° F., the kinetics of reaction (1) are adequate and the methane produced by reaction (1) is considerably more reactive than the methane normally added to a furnace atmosphere even at the lower temperatures noted above. Consequently, the "reactive" methane formed in reaction (1) causes increased reaction rates in reactions (2) and (4) due to the mixing of the "reactive" $CH_4$ obtained from $C_3H_8$ and the $CH_4$ added to the furnace atmosphere as such. It is believed that the "reactive" methane produced in reaction (1) has a synergistic effect in rendering the normally sluggish, added $CH_4$ considerably more active and thus accelerates the kinetics of reactions (2) and (4). Furthermore, the addition of minor amounts of $C_3H_8$ with $CH_4$ as described above does not result in the aforementioned unstable decarburizing/sooting conditions which occur from the addition of $C_3H_8$ alone and thus, the process according to the invention is more easily controlled. That is, changes in the $CO_2$ or $H_2O$ levels of the furnace hot zone due to variations in air leakage etc., can be counteracted by changes in the $C_3H_8$ and $CH_4$ flows by conventional control equipment without causing decarburization or sooting.

Figure 2:
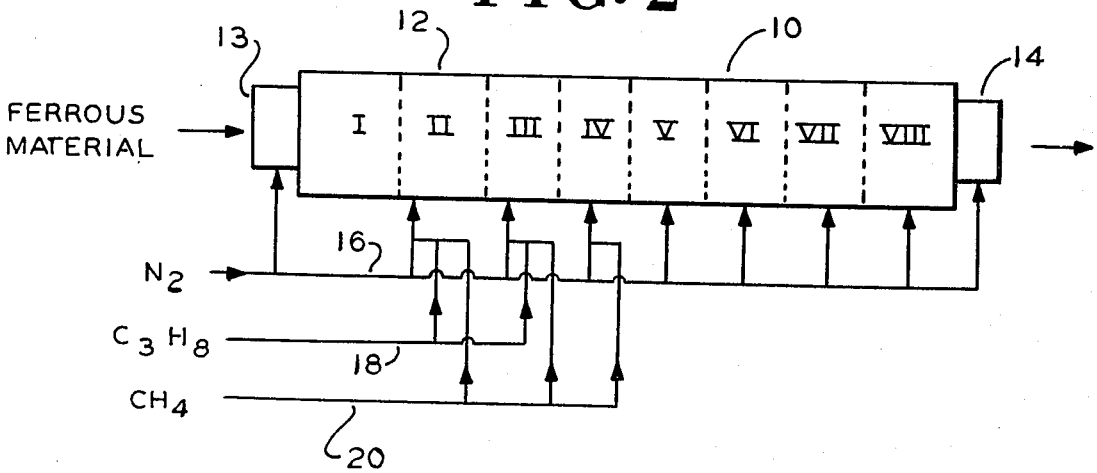
FIG. 2 is a diagrammatic view of a heat treating furnace and equipment for supplying furnace atmosphere constituents thereto in accordance with the invention.

Referring now to FIG. 2, illustrated therein is an exemplary embodiment of a heat treating furnace 10 together with means for supplying appropriate gases thereto. Furnace 10 which may be a continuous furnace of the roller hearth design, is provided with charge and discharge vestibules 13 and 14, respectively. The hot zone 12 of furnace 10 may be considered to be comprised of a plurality of zones 1-VIII between vestibules 13 and 14. A suitable set of conduits 16 is provided to enable the supply of nitrogen to charge and discharge vestibules 13 and 14 as well as to various zones of hot zone 12. Typically, nitrogen is introduced into zones II–VIII of a hot zone 12 of a continuous roller hearth furnace 10. A set of conduits 18 is provided to enable propane to be supplied to certain zones of furnace 10 such as zones II and III, while a similar set of conduits is provided to enable methane to be supplied to zones such as zones II–IV. Ferrous material is introduced into charge vestibule 13, is passed through the zones I–VIII of hot zone 12 and is discharged through vestibule 14 in the arrows illustrated in FIG. 2.

In operation, zones such as zones I–III of hot zone 12 are brought to a predetermined "soaking" temperature of say 1500° F. while subsequent zones are at lower temperatures but are maintained at levels of 1100° F. or greater. Nitrogen is supplied to vestibules 13 and 14 for the purpose of excluding oxygen therefrom and avoiding any possibility of explosions. In order to affect annealing, without altering the carbon content of ferrous material, nitrogen, propane and methane are supplied to zones II and III of hot zone 12. As mentioned previously, the $C_3H_8$ so introduced reacts with a portion of the oxidants such as $H_2O$ or $CO_2$ leaking into hot zone 12 to form a highly active form of methane which in turn reacts with other portions of such oxidants to generate CO and $H_2$ in accordance with reactions (1)–(4) described above. In this manner, the ferrous material being passed through furnace 10 is annealed without significant carburization or decarburization or oxidation. Nitrogen and methane may be supplied through conduit 20 to assure adequate levels of hydrocarbon in another zone IV of hot zone 12 so that any $CO_2$ or $H_2O$ which may be present is reacted so as to avoid decarburization and/or oxidation. Cooling zones V–VIII require a lower CO content to prevent carbon pickup or sooting and only nitrogen need be added (through conduit 16) to these zones.

It will be understood that various grades of steel in various forms such as tube, bar, rod or strip, etc. may be annealed by the method according to the invention. The temperatures and processing times will vary but the flow of $N_2$, $C_3H_8$ and $CH_4$ may be readily controlled to establish the desired atmospheres in different zones I–VIII of hot zone 12. For example, AISI S7 tool steel bar of 2 inch diameter has been successfully annealed in a continuous roller hearth furnace with no additional significant decarburization from the as received cold drawn or hot rolled material and no sooting occurred. A mixture of approximately 6% natural gas (of 98% methane), 0.25% propane, balance nitrogen was supplied to the zones of highest temperature which was 1500° F. and the resulting annealed bar showed less than 0.0002 inch total affected depth (free ferrite plus partial decarburization).

The process according to the invention may be practiced in batch as well as continuous furnaces. Depending on the particular material to be annealed and the furnace utilized, mixtures of 0–10% $CH_4$, 0–3.0% $C_3H_8$, balance nitrogen may be supplied to the furnace hot zone at soaking temperatures to assure annealing, even at temperatures below 1450° F. without significant alteration of material surface carbon or oxygen levels.

Although nitrogen, propane and methane are depicted as being supplied through conduits 16, 18 and 20, respectively, it will be appreciated that appropriate valves and flowmeters will be provided in each such conduit and that such valves may be manually or automatically controlled. The foregoing constituents may be introduced into hot zone 12 separately or as mixtures as depicted in FIG. 2.

It will be apparent that other modifications to the invention can be made without departing from the spirit thereof and that the scope of the invention is to be determined by the following claims.

What is claimed is:

1. A process for annealing ferrous material in a continuous furnace having charge and discharge vestibules and a hot zone therebetween and into which furnace inward leakage of ambient oxidants occurs, comprising the steps of:

heating said hot zone, which has a plurality of zones therein, to a temperature above 1250° F.;

introducing a mixture consisting essentially of some but not more than 10% methane, some but not more than 3% propane, balance nitrogen into one or more zones of said hot zone wherein said propane reacts with a portion of said oxidants to form relatively active methane which together with said introduced methane effectively precludes decarburization of said material;

introducing a mixture consisting essentially of nitrogen and methane into a further zone of said hot zone; and introducing essentially only nitrogen into still further zones of said hot zone.

2. The process defined in claim 1 wherein said step of introducing said mixture of propane, methane and nitrogen comprises supplying said mixture into at least two of said zones in said hot zone.

3. The process defined in claim 1 wherein the step of introducing nitrogen, propane and methane into said hot zone comprises introducing a mixture of 6% methane, 0.25% propane, balance nitrogen.

4. A process for annealing ferrous material in a continuous furnace having charge and discharge vestibules and a hot zone therebetween and into which furnace inward leakage of ambient oxidants occurs, comprising the steps of:

heating said hot zone, which has a plurality of zones therein, to a temperature above 1250° F.;

introducing a mixture consisting essentially of some but not more than 10% methane, some but not more than 3% propane, balance nitrogen into one or more zones of said hot zone wherein said propane reacts with a portion of said oxidants to form relatively active methane which together with said introduced methane effectively precludes decarburization of said material; and introducing nitrogen into said charge and discharge vestibules.

* * * * *